US007354490B2

(12) United States Patent
Fritzemeier et al.

(10) Patent No.: US 7,354,490 B2
(45) **Date of Patent: *Apr. 8, 2008**

(54) CRYOMILLED ALUMINUM ALLOYS AND COMPONENTS EXTRUDED AND FORGED THEREFROM

(75) Inventors: Leslie G. Fritzemeier, Mendon, MA (US); Daniel E. Matejczyk, West Hills, CA (US); Thomas J. Van Daam, Simi Valley, CA (US)

(73) Assignee: The Boeing Company, Seattle, WA (US)

( * ) Notice: Subject to any disclaimer, the term of this patent is extended or adjusted under 35 U.S.C. 154(b) by 187 days.

This patent is subject to a terminal disclaimer.

(21) Appl. No.: 10/772,690

(22) Filed: Feb. 5, 2004

(65) Prior Publication Data

US 2004/0228755 A1 Nov. 18, 2004

Related U.S. Application Data

(63) Continuation of application No. 10/263,135, filed on Oct. 2, 2002, now Pat. No. 6,902,699.

(51) Int. Cl.
*C22C 21/00* (2006.01)
*C22C 21/06* (2006.01)

(52) U.S. Cl. ..... 148/437; 419/13

(58) Field of Classification Search ..... 420/528, 420/533, 534, 535, 537, 542, 543, 544, 546, 420/548; 75/249; 419/13; 148/437, 438, 148/439, 440

See application file for complete search history.

(56) References Cited

U.S. PATENT DOCUMENTS 3,172,546 A 3/1965 Schreiner
3,740,210 A 6/1973 Bomford et al.
3,771,729 A 11/1973 Frable
4,090,874 A 5/1978 Kaufman (Continued)

FOREIGN PATENT DOCUMENTS

EP 577436 A1 * 1/1994

OTHER PUBLICATIONS

Liao, X.Z. et al., Deformation mechanisms at different grain sizes in a cryogenically ball—milled A1 -Mg alloy, Ultrafine Grained Materials II (2002), 323-330, Photomicrographs, Diffraction Ptters, 16 Ref. Minerals, Metals and Materials Society/Aime, Warrendale, PA; Conference: Ultrafine Grained Materials II.

(Continued)

*Primary Examiner*—Roy King
*Assistant Examiner*—Janelle Morillo
(74) *Attorney, Agent, or Firm*—Alston & Bird LLP

(57) ABSTRACT

High strength aluminum alloy powders, extrusions, and forgings are provided in which the aluminum alloys exhibit high strength at atmospheric temperatures and maintain high strength and ductility at extremely low temperatures. The alloy is produced by blending about 89 atomic % to 99 atomic % aluminum, 1 atomic % to 11 atomic % of a secondary metal selected from the group consisting of magnesium, lithium, silicon, titanium, zirconium, and combinations thereof, and up to about 10 atomic % of a tertiary metal selected from the group consisting of Be, Ca, Sr, Ba, Ra, Sc, V, Cr, Mn, Fe, Co, Ni, Cu, Zn, Y, Nb, Mo, Tc, Ru, Rh, Pd, Ag, Cd, W, and combinations thereof. The alloy is produced by nanostructure material synthesis, such as cryomilling, in the absence of refractory dispersoids. The synthesized alloy is then canned, degassed, consolidated, extruded, and optionally forged into a solid metallic component. Grain size within the alloy is less than 0.5 μm, and alloys with grain size less than 0.1 μm may be produced.

10 Claims, 3 Drawing Sheets

U.S. PATENT DOCUMENTS

| | | | | | |
|---|---|---|---|---|---|
| 4,129,443 | A | | 12/1978 | Kaufman | |
| 4,239,159 | A | | 12/1980 | Johns | |
| 4,619,699 | A | * | 10/1986 | Petkovic-Luton et al. | 75/252 |
| 4,647,304 | A | | 3/1987 | Petkovic-Luton et al. | |
| 4,818,481 | A | * | 4/1989 | Luton et al. | 419/67 |
| 4,853,179 | A | | 8/1989 | Shiina | |
| 5,635,654 | A | * | 6/1997 | Hebsur et al. | 75/244 |
| 5,775,603 | A | | 7/1998 | Kohler et al. | |
| 6,042,631 | A | * | 3/2000 | Kondoh et al. | 75/244 |

OTHER PUBLICATIONS

Aikin, B..J.M. et al, Improvements in cryomill processing. Advanced Particulate Materials & Processes (1997), 287-294, Graphs, 6 Ref. Metal Powder Industries Federation, Princeton, NJ; Conference: 5th International Conference on Advanced Particualte Materials & Proce.

Lee, Z. et al., Microstructural evolution of cryomilled nanocrystalline A1-Ti-Cu alloy, Ultrafine Grained Materials II (2002), 653-659, Diffraction Patters, Photomicrographs, Graphs, 10 Ref. Minerals, Metals and Materials Society/Aime, Warrendale, PA; Conference: Ultrafine Grained Materials II.

Choi, J.H. et al., Consolidation behavior of nanocrystalline A1—5at.%Ti alloys synthesized by cryogenic milling, Journal of Alloys and Compounds (Feb. 9, 2001) 315, (1-2), 178-186, Diffraction Patterns, Photomicrographs, Graphs, 22 Ref. ISSN: 0925-8388.

* cited by examiner

CRYOMILLED ALUMINUM ALLOYS AND COMPONENTS EXTRUDED AND FORGED THEREFROM

CROSS-REFERENCE TO RELATED APPLICATIONS

This application is a continuation of U.S. application Ser. No. 10/263,135, now U.S Pat. No. 6,902,699, filed Oct. 2, 2002, which is hereby incorporated herein in its entirety by reference.

FIELD OF THE INVENTION

The present invention relates to the production of high strength cryomilled aluminum alloys, and to the extrusion and forging of cryomilled aluminum alloys.

BACKGROUND OF THE INVENTION

The aerospace industry requires structural metals and alloys that provide maximum strength with minimum weight. Traditionally, these roles have been fulfilled by aluminum, titanium, and alloys thereof. However, as the performance demands of the industry have increased, previously known aluminum and titanium alloys have been pushed to the limits of their usefulness.

The operation of high performance rocket propulsion systems are particularly demanding on metallic components. Extruded and forged parts such as fuel turbopump impellers and other rotational components require high strength and low density, but also require adequate ductility and toughness. Furthermore, because the rotational components of liquid-fueled rocket engines are exposed to cryogenic liquids at very high pressure and low temperature, the rotational components must retain their high strength and ductility in an extremely cold environment.

In the past, high performance aluminum alloy components, such as those used in rocket propulsion systems, were strengthened through precipitation heat treatment, resulting in tensile strengths of up to 80 ksi. The heat treated aluminum parts remain adequate for most modem day propulsion systems but fall short of meeting the demands of today's high-performance rocket engines and other similarly demanding propulsion systems. The components formed by precipitation heat treatment are not particularly suited for use in extremely cold environments such as those temperatures found in liquid fuel rocket engines. Further, heat treatment introduces residual stress and distortion in the metallic components, which is particularly troublesome in thin-walled or high-precision components.

The technology of dispersion strengthening has provided aluminum alloys having strength and durability beyond that provided by precipitation heat treatment. The dispersion strengthened aluminum alloys are metallic aluminum alloys having a second phase material of fine particles, dispersed within the metal in a substantially homogenous dispersion. The second phase particles are typically oxides of the aluminum found within the alloy and may also be nitrides, borides, oxy-nitrides, or carbo-nitrides. The dispersion strengthened aluminum alloys exhibit improved physical properties over and above those of heat treated aluminum, including increased mechanical strength and an increase in the temperature at which the mechanical strength of the alloy begins to fade. Components constructed of dispersion-strengthened aluminum, sometimes known as sintered aluminum products (S.A.P.), have high levels of hardness and tensile strength and maintain those mechanical properties at higher temperatures than comparable aluminum alloys which are not dispersion-strengthened.

The most successful dispersion strengthened alloys have been produced by dispersing metal oxides within metal alloys through cryogenic milling. The cryogenic milling, which usually takes place in liquid nitrogen or a similar chilled atmosphere, provides an ultra-fine dispersion of oxide particles within the alloy and also increases the strain energy that is stored within the alloy, resulting in reduced grain size upon reheating of the metal. The ultra-fine dispersion of oxides and reduced grain size leads to an alloy of relatively high strength, particularly at high temperatures.

The use of dispersion strengthened aluminum alloys in propulsion systems is well studied, and several variations of the dispersion strengthened alloys and methods of producing the alloys are available. For instance, U.S. Pat. No. 3,740,210 to Bomford, et al. discloses the milling of aluminum and aluminum oxide powders in a ball mill with asymmetric organic compounds acting as surfactant agents. The surfactant acts to retard the welding of aluminum to itself within the ball mill, thus allowing the comminuted aluminum and aluminum oxide to be mutually interdispersed in the composite powder. Reduction of the metallic welding also prevents the ball mill from being frozen by agglomerated metal welded between the balls and inner walls of the mill. The favorable intermingling of the aluminum and aluminum oxides provides a composite alloy powder having well dispersed oxides which leads to a high strength, high temperature alloy product.

U.S. Pat. No. 4,818,481 to Luton, et al. discloses the use of cryomilling to disperse a second phase within an aluminum alloy. Luton '481 explains that the repeated fracture and cold-welding of metal powder involved in ball milling causes strain energy to be stored within the milled particles. Recrystallization occurs with longer milling times, resulting in decreased grain size over that of the starting powders. The decreased grain size corresponds to a better dispersed secondary phase within the alloy which, in turn, results in improved mechanical properties in the finished product. Although considerable research has occurred regarding different types of oxide dispersions and methods by which oxide, nitride, and other precipitates are dispersed within aluminum alloys, the improvement in the strength of the dispersion strengthened alloys over the heat treated alloys of the past is fairly modest. Furthermore, the dispersion-strengthened aluminum alloys are designed for use at high temperatures, and are not particularly suited for use in extremely low temperature environments.

Modern, advanced liquid fuel rocket motors require pump components of extremely high strength which are capable of maintaining strength and ductility at extremely low temperatures, due to the use of liquid hydrogen as a rocket fuel. The aluminum components must be capable of continual high-speed operation, typically below −300° F. Existing heat treated and dispersion strengthened aluminum alloys are unable to meet the demands of the next generation of rocket motors and their high stress, extremely low temperature environments.

What are needed are improved aluminum alloys which are not based upon heat treating techniques or dispersion strengthening techniques of the past, and which are capable of withstanding the extremely low temperatures and extreme mechanical stresses inherent in high-performance rocket propulsion systems. What is further needed is a manner of preparing the improved alloys. What is still further needed is a manner of extruding and forging components from the improved alloys in order to obtain products exhibiting extremely high strength and extremely low temperatures.

SUMMARY OF THE INVENTION

High strength aluminum alloy powders, extrusions, and forgings are provided by the instant invention. Methods of producing high strength aluminum alloy powders, extrusions, and forgings are also provided by the instant invention. The aluminum alloys exhibit high strength at atmospheric temperatures and maintain high strength and ductility at extremely low temperatures. The alloys may be formed into rocket motor components capable of withstanding high stresses. Uses for the alloys are wide ranging, but the alloys are particularly suited for production of components for use in liquid fuel rocket motors in the form of pump impellers and ancillary components which must endure extremely low temperatures during operation.

The foundation of the invention is the creation of aluminum alloy powders having a very fine and stable grain structure. The fine grain structure, small grain size, and other physical properties inherent to the invented alloy result in metal components extruded or forged from the alloy powder which have high strength and which maintain high strength and ductility even at very low temperatures. The alloy powder is produced by blending aluminum and a secondary metal selected from magnesium, lithium, silicon, titanium, and zirconium, and synthesizing nanostructured materials from the powder, preferably by cryomilling. The secondary metal is either alloyed with the aluminum prior to cryomilling or the magnesium and aluminum are supplied as a blend and alloyed during the cryogenic milling. In either situation, it is preferred that refractory material such as oxides, nitrides, carbides, and borides, are not added to the metallic alloy prior to or during cryomilling.

The alloy of the invention is about 89 atomic % to about 99 atomic % aluminum, and about 1 atomic % to about 11 atomic % of the secondary metal. Optionally, the alloy contains up to 10 atomic % of a metal selected from Be, Ca, Sr, Ba, Ra, Sc, V, Cr, Mn, Fe, Co, Ni, Cu, Zn, Y, Nb, Mo, Tc, Ru, Rh, Pd, Ag, Cd, W, or combinations thereof.

Cryomilling the aluminum and secondary metal in accordance with this invention provides a resultant metallic powder having a very stable grain structure. The average grain size within the alloy is less than 0.5 μm, and alloys with average grain size less than 0.1 μm may be produced. The small, stable grains of the alloy allow components to be extruded or forged from the alloy which exhibit significantly improved strength over similar alloys produced by other methods. The cryomilled aluminum alloys also exhibit dramatically improved strength at low temperatures.

The method does not rely on the supplemental addition of oxides, nitrides, or similar refractory substances, as do previously methods of cryomilling metals. The invented alloy gains its strength from the unique composition of the material and the unique processing techniques used in the milling of the alloy. Refractory materials are preferably present within the invented alloy in amounts less than about 0.5 volume %. More preferably, refractory materials are present in amounts of less than about 0.2%.

The aluminum and secondary metal are alloyed together and cryomilled as a solid solution and, to a small degree, as a precipitate. Since liquid nitrogen is used as the cooling solution for cryomilling, small amounts of nitrogen may be introduced into the alloy as a result of the exposure of the aluminum metal to nitrogen during the cryomilling. It has been found that this nitrogen does not form refractory-type nitrides to any appreciable degree. Once again, the alloy relies on unique grain properties gained during processing, rather than the oxide/nitride dispersion strengthening used in previous high strength cryomilled aluminum alloys.

After cryomilling of the alloy powder, the powder is maintained in a substantially oxygen free atmosphere. Storage and handling in an argon or a dry nitrogen atmosphere are the preferred means for maintaining the oxygen free atmosphere. The oxygen is kept from the milled alloy so that the surface of the metal particles will not oxidize prior to being extruded. The argon or nitrogen atmospheres also prevent the metal powder from absorbing moisture before further processing can take place. The cryomilling results in an alloy with average grain size of less than 0.5 μm, and preferably less than 0.1 μm.

The milled metal powder is packed within a sealed can. The can provides a form to the metal and also provides evacuation tubing for degassing the powder. While in the can, the powder is heated to a temperature between about 600° F. and about 850° F. and gaseous components within the powder are evacuated by a vacuum pump connected to the evacuation tubing of the can. Temperature and pressure are maintained until substantially all of the hydrogen and substantially all of any free nitrogen are removed. At the conclusion of this degassing operation, the evacuation tube is sealed by crimping and then welding.

After evacuation, the sealed can of powder is placed in a hot isostatic press. The press is used to maintain the temperature of the metal powder between about 600° F. and about 850° F. while exerting a pressure upon the metal of between about 15 ksi (kilopounds/in$^2$) and about 30 ksi. The pressure and temperature are maintained until the metal reaches almost 100% of the metal's porosity free density.

After the metal powder is compressed, the consolidated metal alloy is extruded at a temperature, extrusion ratio area, and ram speed appropriate for the particular alloy. Extrusion is sufficient to form a wide variety of high strength components, such as those to be used in a liquid fueled rocket engine. Those components that are not adequately shaped by extrusion may be further forged into the desired shape. Forging may also be used to provide additional ductility in directions other than the extrusion axis.

The physical properties of the alloy are present within the invented alloy powder produced in accordance with the invention. The extraordinary strength and the ability of the alloy to maintain high strength at extremely low temperatures is believed to be due to the unique grain structure, grain size, and interaction of constituents of the alloy caused by the cryomilling process. The improved physical properties of the alloy are exhibited when the alloy powder is compressed and extruded into a solid metal component. The metal components produced from the powder have an extremely high yield strength, between about 73 ksi and about 104 ksi, and ultimate tensile strength, between about 78 ksi and about 107 ksi. More importantly, the metal alloys have the same or higher yield strength at low temperatures, ranging from about 67 ksi to about 126 ksi at −320° F., and ranging from about 78 ksi to about 106 ksi at −423° F. Similarly, the ultimate tensile strength of the alloys ranges from about 78 ksi to about 129 ksi at −320° F. and from about 107 ksi to about 121 ksi at −423° F.

The invented alloys produced with the invented method therefore permit the production of high strength components which have maintained or improved strength at very low temperatures. The high strength alloys are well suited for use within liquid fuel rocket motors, particularly as turbopump impellers and propellant ducts for reusable launch vehicles.

Components extruded or forged from the alloys are light weight, but are able to resist the extreme forces and extremely low temperatures experienced within the rocket engine. Thus, by utilizing the components formed from the invented alloy, higher capacity, low weight rocket engines may now be constructed.

BRIEF DESCRIPTION OF THE DRAWINGS

Figure 1:
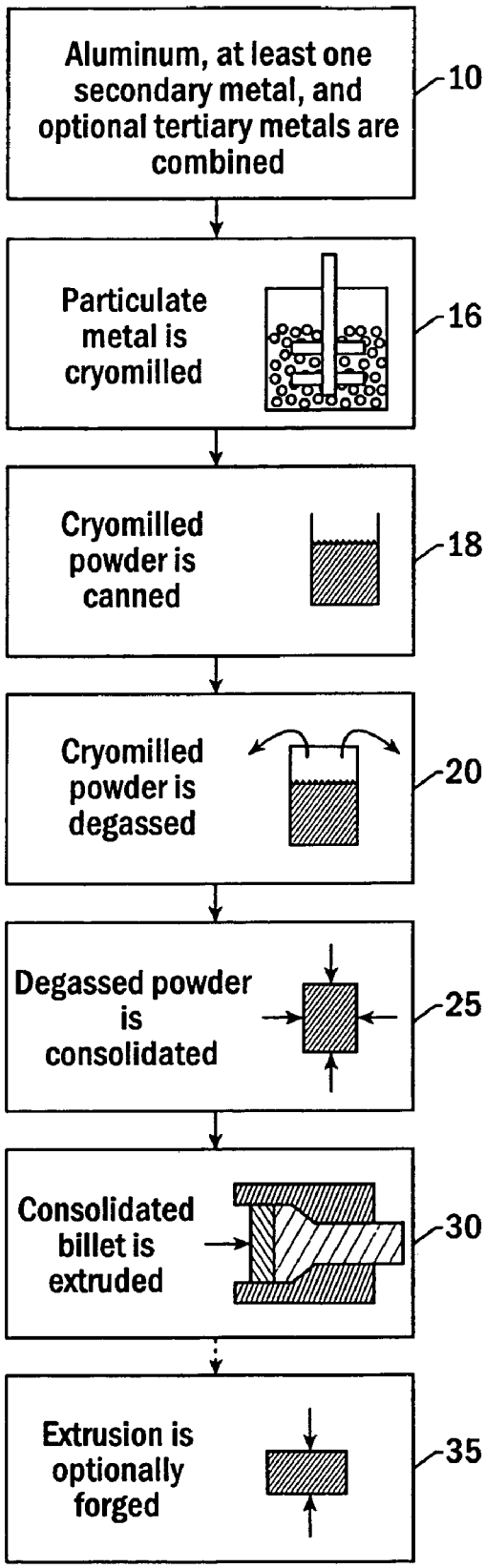
Figure 2:
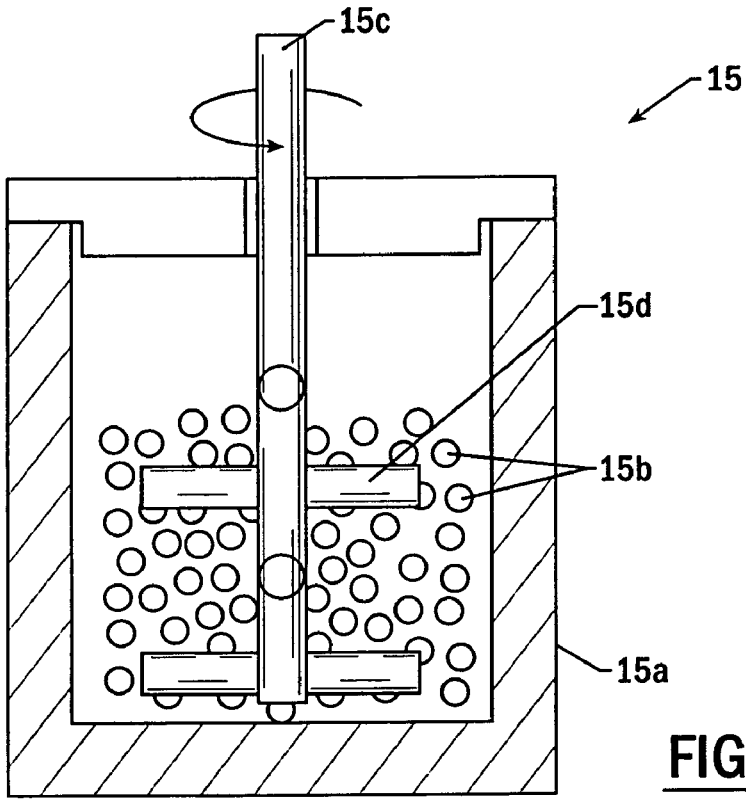
Figure 3:
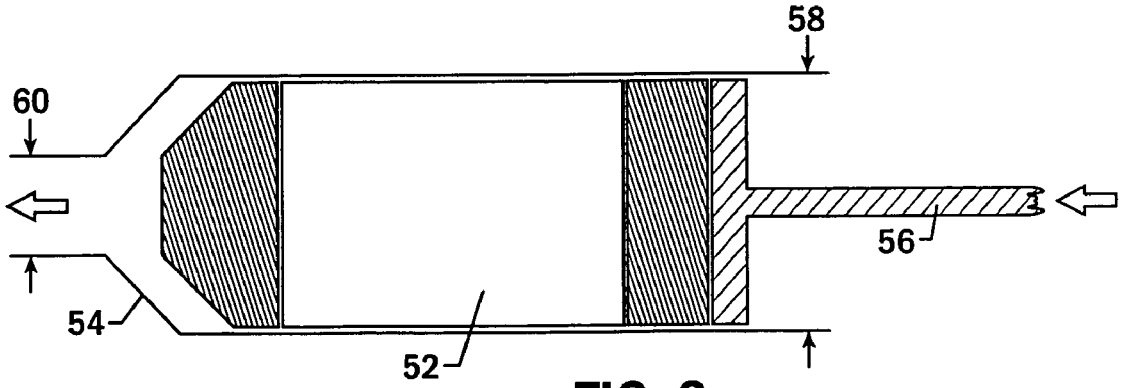
Figure 4:
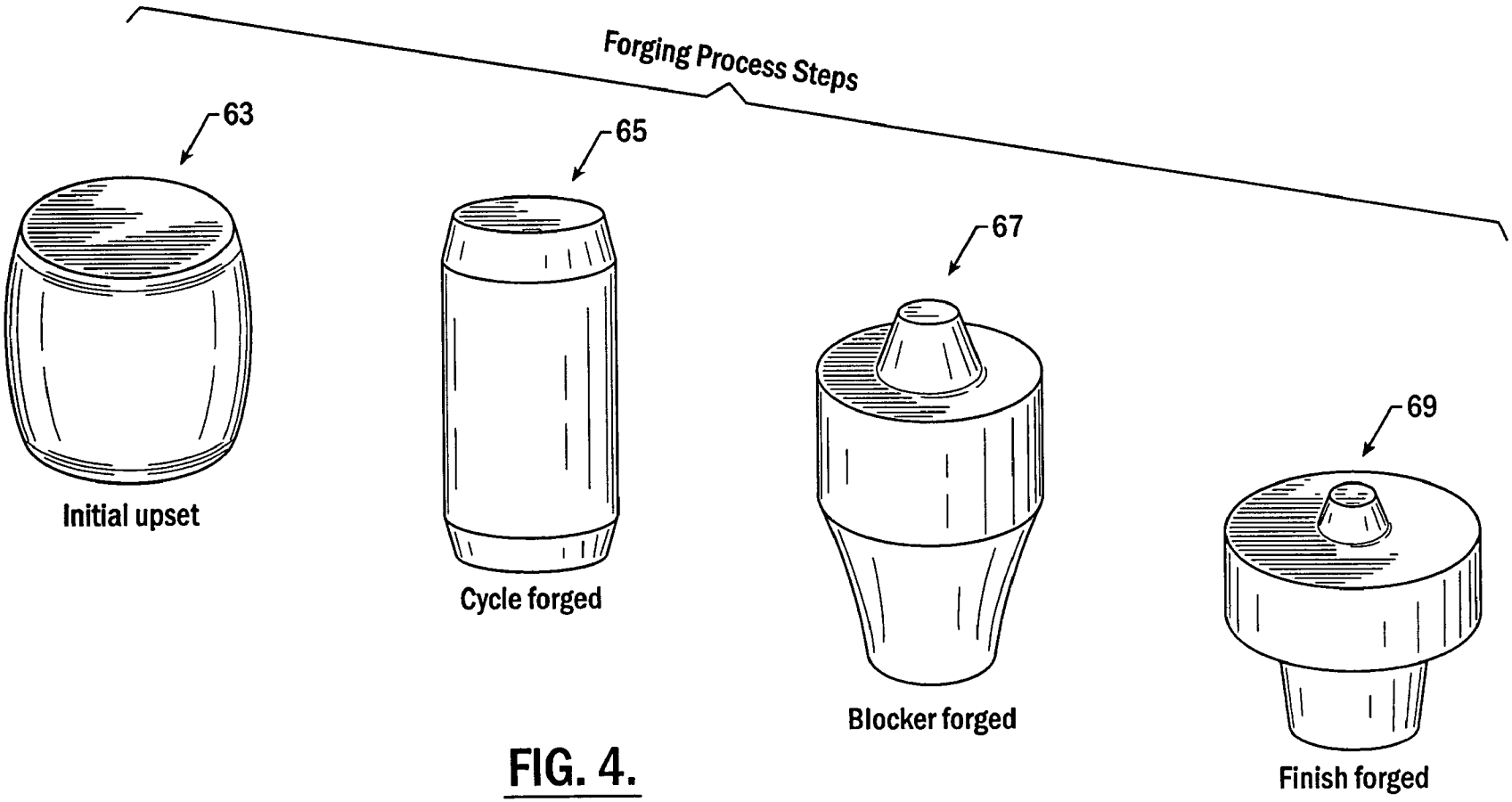

Having thus described the invention in general terms, reference will now be made to the accompanying drawing, which is not necessarily drawn to scale, and wherein:

FIG. 1 is a schematic flow diagram of a process embodiment of this invention;

FIG. 2 is a side sectional view of an exemplary ball mill and attritor for use in an embodiment of this invention;

FIG. 3 is a side sectional view of an exemplary extrusion apparatus in accordance with the invention; and FIG. 4 is a composite image showing various stages of forging in accordance with the invention.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

As used herein, "alloy" describes the solid solution of aluminum and a "secondary metal" selected from magnesium, lithium, silicon, titanium, and zirconium which may or may not contain precipitated compounds of aluminum and the secondary metal. In addition, the alloy may contain metal components such as Be, Ca, Sr, Ba, Ra, Sc, V, Cr, Mn, Fe, Co, Ni, Cu, Zn, Y, Nb, Mo, Tc, Ru, Rh, Pd, Ag, Cd, W, or combinations thereof. For convenience, the metals which may be used in accordance with the invention other than aluminum and the secondary metals are referred to hereinafter as "tertiary metals". As with any alloys, the invented alloy may contain very low concentrations of a variety of contaminants or impurities. The invented alloys do not, however, contain appreciable amounts of refractory materials such as oxides, nitrides, borides, carbides, oxy-nitrides, or carbo-nitrides.

As used herein, "nanostructured material synthesis" or similar terminology generally refers to methods of metal production which result in a material having average grain sizes on the order of nanometers. For purposes of the disclosure, nanostructured materials may include those alloys having an average grain size of 0.5 μm or less. For purposes of this invention, nanostructured material synthesis will also include the addition of controlled amounts of nitrogen to the metal alloy.

Cryomilling in liquid nitrogen is the preferred method to develop the fine grain size and also to incorporate nitrogen into the alloy. Therefore, cryomilling is used as the exemplary synthesis method throughout the majority of the disclosure. However, one skilled in the art could also produce this similar alloys using other common methods for formation of nanostructured materials, carried out in a controlled nitrogen environment. These synthesis methods include, but are not limited to, gas condensation, chemical vapor condensation, plasma synthesis, rapid solidification of powder, and severe plastic deformation. Synthesis is always carried out in a nitrogen environment in order to incorporate a limited, controlled amount of nitrogen into the metal or alloy.

As used herein, "cryomilling" describes the fine milling of metallic constituents at extremely low temperatures. Cryomilling takes place within a high energy mill such as an attritor with metallic or ceramic balls. During milling, the mill temperature is lowered by using liquid nitrogen. In an attritor, energy is supplied in the form of motion to the balls within the attritor, which impinge portions of the metal alloy powder within the attritor, causing repeated comminuting and welding of the metal.

The high-strength metal alloy powders, extrusions, and forgings of this invention begin as a pre-alloyed metal or as a combination of metals in the form of small particulates or powder. The base metal of the alloy is aluminum, which makes up about 89 atomic % to about 99 atomic % aluminum. The secondary metal is about 1 atomic % to about 11 atomic % of a secondary metal selected from magnesium, lithium, silicon, titanium, and zirconium, or combinations thereof. Optionally, the alloy contains a tertiary metal of up to 10 atomic % selected from Be, Ca, Sr, Ba, Ra, Sc, V, Cr, Mn, Fe, Co, Ni, Cu, Zn, Y, Nb, Mo, Tc, Ru, Rh, Pd, Ag, Cd, W, or combinations thereof.

By way of comparison, 11 atomic % of the secondary metal in aluminum is equivalent to about 10 weight % magnesium, 3 weight % lithium, 11 weight % silicon, 18 weight % titanium, or 30 weight % zirconium.

When intimately combined, mixed, and milled, the aluminum and secondary metal forms a solid solution containing small amounts of precipitated aluminum-secondary metal. When magnesium is used as the secondary metal, the equilibrium aluminum-magnesium precipitate formed is $Al_3Mg_2$, though other non-equilibrium phases of the precipitate may also be present. Any other metals, optionally added to the aluminum and magnesium mixture form a solid solution with the aluminum and magnesium.

If the beginning metal powder is supplied as pre-alloyed powder, then it can proceed directly to the cryomilling process. Metal powders that have not been previously alloyed can also proceed to the cryomilling step, since the cryomilling will intimately mix the aluminum constituent with the secondary constituent and thereby alloy the metals.

Prior to milling, it is preferred to handle the starting metal powders in a substantially oxygen free atmosphere. For instance, the aluminum is preferably supplied by atomizing the aluminum from an aluminum source and collecting and storing the atomized aluminum in a container under an argon atmosphere. The aluminum is held in the argon atmosphere, or in a dry nitrogen atmosphere, throughout all handling, including the operation of mixing the aluminum powder with the secondary metal prior to milling. Holding the raw aluminum within an argon or nitrogen atmosphere prevents the surface of the aluminum particles from excessive oxidation. The inert atmosphere also prevents contaminants such as moisture from reacting with the raw metal powder. Since magnesium and other metals readily oxidize, they are treated in the same manner as aluminum prior to milling. Thus, the aluminum and other metal powders are supplied uncoated, meaning without a coating of metal oxides.

The use of source metal powder having oxide coatings does not completely destroy the strength and low temperature benefits gained through the invented process, but alloys produced with a minimum of oxide content are preferred, and alloys having almost no oxide content may be produced in accordance with this invention. Further, supplemental refractory materials such as oxides, carbides, nitrides, borides, oxy-nitrides, carbo-nitrides, and the like are not added to the alloy. Though supplemental refractory dispersoids usually strengthen metal alloys through dispersion strengthening, oxides occurring naturally upon the surface of the metal starting materials are not preferred in the invented alloy, and supplemental refractory dispersoids cause notable deterioration in the physical properties of the alloy.

Referring now to FIG. 1, once the constituents of the aluminum alloy are selected 10, the combined or pre-alloyed metal powder is cryomilled 15. As noted above, cryomilling is the repeated comminuting and welding of the metal particles in a very low temperature environment.

It is preferred that the cryomilling 15 of the very small particles of metal powder take place within a ball attritor. As shown in FIG. 2, the ball attritor is typically a cylindrical vessel 15*a* filled with a large number of ceramic or metallic spherical balls 15*b*, preferably stainless steel. A single fixed-axis shaft 15*c* is disposed within the attritor vessel, and there are several radial arms 15*d* extending from the shaft. As the shaft 15*c* is turned, the arms 15*d* cause the spherical balls 15*b* to move about the attritor. When the attritor contains metal powder and the attritor is activated, portions of the metal powder are impinged between the metal balls 15*b* as they move about the attritor. The force of the metal balls 15*b* repeatedly impinges the metal particles and causes the metal particles to be continually comminuted and welded together. This milling of the metal powder effectively cold-works the metal.

Cold working imparts a high degree of plastic strain within the powder particles. During cold working, the repeated deformation causes a buildup of dislocation substructure within the particles. After repeated deformation, the dislocations evolve into cellular networks that become high-angle grain boundaries separating the very small grains of the metal. Grain diameters as small as approximately $2.5\times10^{-8}$ meter have been observed via electron microscopy and measured by x-ray diffraction at this stage in processing. Structures having dimensions smaller than $10^{-7}$ meter, such as those found in the metallic produced at this stage in the invented process, are commonly referred to as nanostructured.

Stearic acid may be added as one of the components to be milled with the metal powder. It promotes the fracturing and re-welding of metal particles during milling, leading to more rapid milling, and leading to a larger fraction milled powder produced during a given process cycle.

During milling 16, the metal powder is reduced to and held at a temperature of approximately −320° F. by exposure of the metal powder to liquid nitrogen. The liquid nitrogen is a convenient way to lower the temperature of the entire cryomilling system. Also, surrounding the metal powder in liquid nitrogen limits exposure of the metal powder to oxygen or moisture. In operation, the liquid nitrogen is placed inside the attritor, in contact with the metal particles and the attritor balls.

The operating parameters of the cryomilling 16 will depend upon the size of the attritor. For example, a 150 liter (40 gal) attritor is preferably operated at a speed of about 100 rpm. The amount of powder added to the attritor is dependent upon the size and number of balls within the attritor vessel. For a 150 liter attritor filled with 640 kg of 0.25" diameter steel balls, up to approximately 20 kg of metal power may be milled at any one time.

Milling 16 is continued for a time sufficient to reach an equilibrium nanostructrue grain size within the metal. A milled metal powder having well dispersed metal constituents and metallic precipitate was found to be one that had been cryomilled to an extent to provide a minimum nitrogen content of 0.3%.

After milling 16, the metal alloy powder is a homogenous solid solution of aluminum, optionally having other added tertiary metal components and optionally having minor amounts of metallic precipitate interspersed within the alloy. Grain structure within the alloy is very stable and grain size is less than 0.5 μm. Depending on the alloy and extent of milling the average grain size is less than 0.3 μm, and may be lower than 0.1 μm.

Not wishing to be bound by theory, a proposed mechanism for the development of the stable fine grain size in this material is that the nitrogen that is incorporated into the alloy during processing interacts with aluminum and the secondary metal to provide the stability against grain growth. Discrete particles such as nitrides are unobserved at magnifications up to 100,000× (sufficient to resolve particles as small as $10^{-8}$ m). Nevertheless, the free energy of formation of aluminum nitride or of magnesium nitride may be characteristic of the effect of nitrogen in the alloy. Both aluminum nitride and magnesium nitride have large negative free energies of formation, −287.0 kJ/mole for AlN, and −400.5 kJ/mole for $Mg_3N_2$.

After the metal alloy powder, with the proper composition and grain structure, is produced, it is transformed into a form that may be shaped into a useful object. The metal powder is canned 18, degassed 20, and then compacted and welded 25. After the combined step of compacting and welding 25, also referred to as consolidating 25, the metal is a solid mass which may be worked and shaped. The consolidated metal is extruded 30 into a usable metal component, and forged 35 if necessary.

At all times from cryomilling 15 through the completion of consolidation 25, the alloy powder is handled in either a dry nitrogen atmosphere or a vacuum. The inert atmosphere prevents oxidation of the surface of the alloy powder particles. The inert atmosphere further prevents the introduction of moisture to the alloy and prevents other contaminants, which might be problematic in the extruded solid, from entering the powder.

Canning 18 of the alloy powder involves placing the powder within a sealed airtight container. The container, or can, is equipped with an evacuation port to be used in subsequent degassing 20. The alloy powder is degassed 20 while held in the can. A vacuum pump is operatively attached to the evacuation port of the can and used to provide a vacuum of approximately $10^{-6}$ torr or better. The temperature of the metal alloy is raised, concurrently with the vacuum treatment, to a temperature of between about 600° F. and about 850° F., and preferably about 775° F. to about 850° F. The elevated temperature and decreased pressure cause the evacuation of gaseous components from the metal alloy powder.

The degassing 20 removes components of any stearic acid included with the powder metal blend when cryomilled within the attritor. Hydrogen, which evolves from the stearic acid, is the main degassed component. Nitrogen found within the interstices of the powder, as well as nitrogen used to evacuate the can prior to packing with the metal particles, is also degassed. Small amounts of oxygen or moisture present within the powder may also be removed from the powder during the degassing. Degassing 20 is theoretically continued until no free gas species remain in the alloy powder, but is practically continued until the content of hydrogen is below 5 weight parts per million (wppm).

The fine grain size of the metal has the unique and useful property of being stable on annealing to temperatures of about 850° F. This enables the powder to endure the relatively high temperatures experienced during degassing 20 and consolidation 25 while maintaining the fine grain size that contributes to strength.

After degassing 20, the alloy powder is transferred to a hot isostatic press (HIP). The temperature of the powder is either maintained at between about 600° F. to about 850° F. after degassing 20 or, if the temperature of the alloy has been allowed to drop, reheated to between about 600° F. to about 850° F. While maintaining the elevated temperature, the powder is pressurized with argon and compressed within the press at a static pressure of between about 15 ksi and about 30 ksi. The temperature and pressure exerted upon the metal alloy powder cause the metal particles to be consolidated into a singular solid billet. The pressure and temperature are maintained until the mass of consolidated metal is nearly 100% free of porosity. Though pressing times will vary with the exact alloy being consolidated, a typical hot isostatic pressing time will be approximately 4 hours.

It is preferable that the hot isostatic pressing (HIPing) take place while the metal is sealed within the degassing can. Under such circumstances, the high-pressure argon, or other inert gas, simply deforms the can, consolidating the metal powder within the can.

After consolidation 25, the solid metal alloy is extruded 30. Extrusion 30 may be used to form the solid into a blank for later forging or may be used to form the solid metal directly into a usable part. The extrusion process typically alters the physical properties of the alloy somewhat. For instance, extrusion decreases the hardness and increases the grain size of the consolidated billet. Also, tensile ductility is notably improved after extrusion.

Referring to FIG. 3, the consolidated alloy is typically shaped in the form of a cylindrical billet 52 having a first diameter 58. The aluminum alloy billet 52 is forced through a conical die 54 by a ram 56. When the consolidated alloy 52 is extruded, the diameter of the billet is reduced to a second diameter 60 and the length of the billet 52 is extended. For extrusion 30, the alloy is heated to a temperature between about 350° F. and 450° F., and preferably about 400° F. Extrusion 30 of the alloy preferably occurs at greater than a 6 to 1 extrusion area ratio. The speed of the ram 56 which forces the billet through the die 54 is preferably about 0.02 inches per second. For a 3 inch diameter extrusion at an extrusion ratio of 7:1, this provides an average strain rate of 0.025 $sec^{-1}$.

Components formed from the metal alloy may be forged 35 if extrusion is not capable of producing a part of the proper shape or size. It is also desired to forge those components which need additional ductility in a direction other than the direction of extrusion.

Prior to forging 35, the extruded blank is heated to a temperature of approximately 600° F. Forging is carried out in a sequence of operations that provide improved properties in the direction transverse to the extrusion axis. Forging also is carried out to provide desired shapes. FIG. 4 shows the results of each forging process step. The extruded blank is forged 35 at a low strain rate, sufficient to shape the component, and to provide isotropic structure and properties to the alloy. In one embodiment, the first forging operation is an initial upset forging step. Strain rate during the upset forging should be less than 0.02 per second. The upset forging results in an alloy component having a form as shown as image 63. After upset forging, the component next is forged in sequence along three perpendicular axes, referred to as ABC forging, to thoroughly deform the material, breaking up particle boundary structures, and providing improved properties in the direction transverse to the extrusion axis. The result of ABC forging is shown as image 65. After ABC forging, the alloy component is die forged, referred to as blocker forging, at a strain rate as high as 0.1 per second, resulting in an alloy component such as shown as image 67. After blocker forging, the alloy component is rapidly cooled to room temperature or below in order to limit the growth of an Al—Mg intermetallic phase.

After blocker forging and cooling, the component is finish forged. Finish die forging involves reheating the forged part to about 400° F. and forging the part at a strain rate of less than 0.1 per second, with the result shown as image 69. Overall forging imparts a total strain to the alloy of from about 0.4 to about 0.8. After final forging, the part is preferably air cooled. Forging of the metal forms high-strength aluminum in sizes and shapes beyond those that are producible using extruded product, provides isotropic mechanical properties, in contrast to extrusions, which have lower ductility and toughness in directions transverse to the extrusion direction, and provides a better balance of properties, trading strength to provide beneficial tensile work hardening behavior that provides enhanced ductility and toughness.

The physical properties of the alloy are present within the invented alloy powder produced in accordance with the invention, and are exhibited by the metal alloy components formed through consolidation and extrusion of the metal, and optionally by further forging of the metal. The extraordinary strength and the ability of the alloy to maintain high strength at extremely low temperatures is believed to be due to the unique grain structure, grain size, and interaction of constituents of the alloy caused by the cryomilling process.

The high strength of the alloy produced in accordance with the invention is unrelated to the dispersion of refractory materials such as oxides or nitrides within the alloy. Samples of the cryomilled and consolidated alloy having a content of 7.5 wt. % magnesium and the balance aluminum have been examined a number of times via transmission electron microscopy (TEM) at magnifications up to 100,000×, which is sufficient to resolve particles as small as $10^{-8}$ m. Nitride particles or other second-base particles were not observable at this level of resolution. The observed structure is notably different from that of alloys having nitride or oxide additions that are readably observable via TEM.

The metal components produced from the powder have an extremely high yield strength, between about 73 ksi and about 104 ksi, and ultimate tensile strength, between about 78 ksi and about 107 ksi. More importantly, the metal alloys have the same or higher yield strength at low temperatures, ranging from about 67 ksi to about 126 ksi at −320° F., and ranging from about 78 ksi to about 106 ksi at −423° F. Similarly, the ultimate tensile strength of the alloys ranges from about 78 ksi to about 129 ksi at −320° F. and from about 107 ksi to about 121 ksi at −423° F.

Metallic constituents in addition to aluminum and secondary metals may be combined into the metal alloy in accordance with the invented milling processes. For instance, any or a combination of the tertiary metals listed above may be combined with the aluminum and secondary metal. In particular, preferred alloys of molybdenum, vanadium, tungsten, iron, nickel, cobalt, manganese, copper, niobium, and chromium can be used in accordance with the processes of this invention to produce an alloys having greater low temperature strength than corresponding dispersion strengthened aluminum alloys and other aluminum alloys formed by methods other than by the invented method.

An exemplary embodiment of an alloy which exhibits superior strength characteristics is the alloy containing 1-4.6 wt % magnesium, 6-9 wt % zinc, 2 wt % copper, 2 wt % cobalt, 0.2 wt % zirconium, and 0.2 wt % nickel by weight, with the remainder being aluminum. Cryomilling, consolidating, and extruding the alloy produces a metal part having room temperature and cryogenic temperature strength superior to the basic aluminum-magnesium alloys. Table I below provides tensile data for typical samples of the two materials produced in accordance with the invention. The measurements were based upon a 0.4" diameter extrusion.

TABLE I

| Alloy | Temperature | yield strength (ksi) | ultimate tensile strength (ksi) | elongation (%) | reduction of area (%) |
|---|---|---|---|---|---|
| 2.5 wt % Mg, 8.0 wt % Zn, 1.0 wt % Cu, 1.4 wt % Co, balance Al | −320 F. | 126.8 | 129.1 | 1.8 | 4.7 |
| 7.5 wt % Mg, balance Al | −320 F. | 100.4 | 119.0 | 3.6 | 7.9 |

EXAMPLES

Example 1

Production of Aluminum/Magnesium Alloy

Aluminum alloy powders of composition 6.7 wt % Mg+Al (balance) were cryomilled, canned, degassed, consolidated, and extruded into a 3" diameter bar. Cryomilling was carried out as follows. The attritor was filled with 640 kg grams of 0.25 inch diameter steel balls. Liquid nitrogen was flowed into the attritor. Flow was maintained for at least about one hour to cool the balls and attritor until the rate of boil off was sufficiently low to allow the balls to become completely submerged in the liquid nitrogen. A transfer hopper was loaded with 17445 grams of aluminum powder, 2555 grams of 50 wt % aluminum 50 wt % magnesium powder, and 40 grams of stearic acid. Loading of the hopper was carried out in a glove box under dry nitrogen purge. These components were transferred from the hopper into the attritor by draining from the hopper into a tube inserted through the lid of the attritor vessel. The attritor arms were then rotated in brief pulses to gradually move this powder metal charge down into the liquid nitrogen and steel balls. Next, the attritor speed of rotation was increased to 100 RPM and maintained at 100 RPM for 8 hours. Liquid nitrogen level was maintained above the balls throughout this 8 hours. At the end of the 8 hours, the milled metal powder with liquid nitrogen was drained through a valve in the bottom of the attritor into steel bins. These bins were loaded into a glovebox, where the liquid nitrogen was allowed to boil off, which required approximately 6 to 10 hours. A dry nitrogen purge was maintained during and after boil off to avoid exposing the powder to air or moisture. Dry powder was weighted and packed into storage containers.

The dry powder was loaded into a can approximately 11 inch diameter by 7 inch long. A can lid was welded on to close and seal the can. The can was evacuated by a vacuum pump connected to tube welded to a port in the lid. The can was heated to approximately 600° F. while connected to the vacuum pump, to facilitate degassing of the can. The can was held at 600° F. until the vacuum, measured in the connecting tube, reached a level that indicated that degassing was nearing completion. The can was allowed to cool, then the evacuation tube was crimped and welded to seal the can.

Next, the can and powder were hot isostatic pressed at 600° F. and 15 ksi for 4 hours, consolidating the powder from about 65% to about 100%. The can was removed from the compacted powder billet via machining. The billet was then machined to a cylindrical shape, in preparation for extrusion. The billet was extruded through conical dies, from a diameter of about 9 inches, to a diameter of about 3 inches, at a temperature of about 400 F, at a ram speed of 0.02 inches per second. The extrusion had the longitudinal tensile properties shown in Table II. The demonstrated tensile properties of the alloys treated according to the invented method are superior to corresponding alloys treated according to traditional techniques.

TABLE II

| | $\sigma_y$ (ksi) | $\sigma_u$ (ksi) | elong. (%) | Reduction in Area (RA) (%) |
|---|---|---|---|---|
| 70 F. | 83.0 | 94 | 5.7 | 27.5 |
| −320 F. | 97.4 | 109.3 | 5.7 | 23.3 |

Example 2

Production of Aluminum/Magnesium Alloy

Aluminum alloy powders of composition 8.5 wt % Mg+Al (balance) were cryomilled, canned, degassed, consolidated and extruded into a 3" diameter tube, wall thickness 0.25" (FIG. 3) as described in Example 1. In this case, the extrusion area ratio was 23:1, the ram speed was 0.02 inches per second, and the average strain rate was 0.055 $sec^{-1}$. The extrusion had the tensile properties shown in Table III. The extruded tube exhibited physical properties that were superior to those of tubes having similar metallic components produced by traditional methods.

TABLE III

| | $\sigma_y$ (ksi) | $\sigma_u$ (ksi) | elong. (%) | R.A. (%) |
|---|---|---|---|---|
| 70 F. - long. | 73.4 | 78.3 | 14.2 | 31.5 |
| 70 F. - trans. | 71.4 | 77.5 | 6.7 | 13.6 |
| −320 F. - long. | 85.8 | 91.6 | 12.2 | 16.1 |
| −320 F. - trans. | 85.6 | 89.4 | 7.0 | 10.9 |

Example 3

Production of Al/Mg/Zn/Cu/Co Alloy

Aluminum alloy powders of composition 2.5 wt % Mg+8.0 wt % Zn+1.0 wt % Cu+1.4 wt % Co+Al (balance) (composition similar to AA7090) were cryomilled, canned, degassed, consolidated and extruded into a 0.4" diameter extrusion according to the method of Example 1. The extrusion had the longitudinal tensile properties shown in Table IV, which are superior to those corresponding alloys which were not treated in accordance to the invented method.

TABLE IV

| | $\sigma_y$ (ksi) | $\sigma_u$ (ksi) | elong. (%) | R.A. (%) |
|---|---|---|---|---|
| 70 F. | 104.8 | 107 | 6.3 | 7 |
| −320 F. | 126.8 | 129.1 | 1.8 | 4.7 |

Example 4

Production of Aluminum/Magnesium Alloy

Aluminum alloy powders of composition 6.7 wt % Mg+Al (balance) were cryomilled, canned, degassed, consolidated and extruded into a 3" diameter bar. A segment of the bar was subsequently forged into a small block. The block had the tensile properties shown in Table V, superior to corresponding alloys milled with traditional methods.

TABLE V

| | $\sigma_y$ (ksi) | $\sigma_u$ (ksi) | elong. (%) | R.A. (%) |
|---|---|---|---|---|
| 70 F. | 74.2 | 83.2 | 11.7 | 37.5 |
| −320 F. | 85.2 | 98.3 | 11.8 | 22.0 |
| −423 F. | 105.9 | 121.4 | 7.1 | 8.7 |

Example 5

Production of Aluminum/Magnesium Alloy

Aluminum alloy powders of composition 8.8 wt % Mg+Al (balance) were cryomilled, canned, degassed, consolidated and extruded into a 3" diameter bar according to the method of Example 1. The bar was subsequently forged into a pump-impeller-shaped forging. The forging had the tensile properties in the radial direction shown in Table VI.

TABLE VI

| | $\sigma_y$ (ksi) | $\sigma_u$ (ksi) | elong. (%) | R.A. (%) |
|---|---|---|---|---|
| −320 F. | 67.5 | 78.5 | 4.3 | 4.2 |
| −423 F. | 78.5 | 100.7 | 4.7 | 7.4 |

As shown in the Examples above, aluminum alloys, extrusions, and forgings produced in accordance with this invention exhibit high strength at ambient temperatures and maintain high strength at reduced temperatures such as those experienced in liquid rocket fuel engines. Thus, components produced in accordance with the invention are particularly suited for use in low temperature situations.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A cryomilled aluminum alloy comprising:

89 atomic % to 99 atomic % aluminum;

1 atomic % to 11 atomic % of a secondary metal selected from the group consisting of magnesium, lithium, silicon, titanium, zirconium, and combinations thereof; and at least 0.3% nitrogen by weight that is in the form of aluminum nitride and one or more of magnesium nitride, lithium nitride, silicon nitride, titanium nitride, zirconium nitride, and combinations thereof, wherein the alloy has an average grain size of less than 0.5 μm, and wherein the alloy is cryomilled in a substantially oxygen free atmosphere so that the alloy is substantially free of oxy-nitrides, oxides, and combinations thereof.

2. The aluminum alloy of claim 1, wherein the secondary metal is magnesium.

3. The aluminum alloy of claim 2, wherein the magnesium is present in an amount of 4 weight % to 10 weight % of the alloy.

4. The aluminum alloy of claim 3, and further comprising a tertiary metal selected from the group consisting of zinc, copper, cobalt, zirconium, and nickel.

5. The aluminum alloy of claim 4, comprising 6 weight % to 9 weight % zinc, less than 2 weight % copper, less than 2 weight % cobalt, less than about 0.2 weight % zirconium, and less than about 0.2 weight % nickel.

6. The aluminum alloy of claim 1, wherein the alloy has a stable grain structure up to at least 850° F.

7. The aluminum alloy of claim 1, wherein the alloy is in the form of an extrusion.

8. The aluminum alloy of claim 1, wherein the alloy is in the form of a forging.

9. The aluminum alloy of claim 1, wherein the alloy comprises less than about 0.5 volume % refractory material.

10. A cryomilled aluminum alloy consisting essentially of:

89 atomic % to 99 atomic % aluminum;

1 atomic % to 11 atomic % of a secondary metal selected from the group consisting of magnesium, lithium, silicon, titanium, zirconium, and combinations thereof; and at least 0.3% by weight of nitrogen that is in the form of aluminum nitride and one or more of magnesium nitride, lithium nitride, silicon nitride, titanium nitride, zirconium nitride, and combinations thereof, and wherein the alloy is cryomilled in a substantially oxygen free atmosphere so that the alloy is substantially free of oxy-nitrides, oxides, and combinations thereof, and wherein the alloy is substantially free of refractory materials, and wherein the alloy has an average grain size of less than 0.5 μm.

* * * * *